US006520800B1

(12) United States Patent
Michelbach et al.

(10) Patent No.: US 6,520,800 B1
(45) Date of Patent: Feb. 18, 2003

(54) DEVICE FOR LINKING AND CONNECTING A LINE

(75) Inventors: Thomas Michelbach, Bad Mergentheim (DE); Gisbert Schmahl, Igersheim (DE)

(73) Assignee: Bartec Componenten und Systeme GmbH, Mirgentheim (DE)

( * ) Notice: Subject to any disclaimer, the term of this patent is extended or adjusted under 35 U.S.C. 154(b) by 0 days.

(21) Appl. No.: 09/554,978

(22) PCT Filed: Nov. 19, 1998

(86) PCT No.: PCT/DE98/03445

§ 371 (c)(1),
(2), (4) Date: Jun. 27, 2000

(87) PCT Pub. No.: WO99/27615

PCT Pub. Date: Jun. 3, 1999

(30) Foreign Application Priority Data

Nov. 22, 1997 (DE) ..... 197 51 844

(51) Int. Cl.[7] ..... H01R 9/05

(52) U.S. Cl. ..... 439/578; 439/440; 439/441; 439/98

(58) Field of Search ..... 439/437, 438, 439/440, 441, 436, 578, 583, 584, 585, 271, 587, 274, 275, 279, 359, 367, 579, 834, 835, 439, 98

(56) References Cited

U.S. PATENT DOCUMENTS

| | | | | | |
|---|---|---|---|---|---|
| 3,538,487 | A | * | 11/1970 | Lanham, Jr. | 439/296 |
| 3,656,087 | A | * | 4/1972 | Nutton | 439/438 |
| 5,106,323 | A | | 4/1992 | Gerhard | |
| 5,174,783 | A | | 12/1992 | Stassen et al. | |
| 5,439,386 | A | | 8/1995 | Ellis et al. | |
| 5,529,522 | A | * | 6/1996 | Huang | 439/440 |
| 5,645,450 | A | * | 7/1997 | Yamada et al. | 439/585 |
| 5,823,824 | A | * | 10/1998 | Mitamura et al. | 439/585 |
| 5,911,599 | A | * | 6/1999 | Masuda | 439/578 |

FOREIGN PATENT DOCUMENTS

| | | |
|---|---|---|
| DE | 1043449 | 5/1957 |
| DE | 1203849 | 10/1962 |
| DE | 119998 | 9/1965 |
| DE | 3416676 | 5/1984 |
| DE | 3910937 | 4/1989 |
| DE | 4101175 | 1/1991 |
| DE | 19506862 | 2/1995 |
| DE | 29608612 | 5/1996 |
| EP | 0187636 | 7/1986 |
| EP | 0406102 | 6/1990 |
| EP | 0505911 | 9/1990 |
| EP | 0632529 | 9/1994 |

OTHER PUBLICATIONS

Prospectus—WAGO, Zielgruppenkatalog ZKGH1.8.

* cited by examiner

*Primary Examiner*—Tho D. Ta
(74) *Attorney, Agent, or Firm*—Horst M. Kasper

(57) ABSTRACT

A device for an electrical conduit (20), a heating conductor (21), or heating cable, with a cross subdivided, tubular casing (6) is furnished. The device exhibits two casing parts (8,9,58) disengageably connected to each other, a bush part (42) and at least a contact bolt (48) disposed parallel to the longitudinal axis of the casing (6). A cage tension spring (38) is disposed at the contact bolt (48) of the bush part (42) for connecting of conduit wires. A connection bolt (37) is furnished between the floor (32) of a case (28) and the case tension spring (38) for the contacting of a conduit braided screen (33).

22 Claims, 6 Drawing Sheets

DEVICE FOR LINKING AND CONNECTING A LINE

CROSS-REFERENCES TO RELATED APPLICATIONS (not applicable)

STATEMENT REGARDING FEDERALLY SPONSORED RESEARCH OR DEVELOPMENT (not applicable)

REFERENCE TO A "MICROFICHE APPENDIX" (SEE 37 CFR 1.96)

(not applicable)

BACKGROUND OF THE INVENTION

1. Field of the Invention

The invention relates to a device for coupling and connecting of a line with the features of the preamble of claim one.

2. Description of the Related Art including information disclosed under 37 CFR 1.97 and 1.98

BRIEF SUMMARY OF THE INVENTION

It is an object of the invention to further develop a device with the features of the preamble of claim one in the direction that with a simple means and without losable and misplaceabale small parts, such as screws and the like, and without special tool, an assembly can be reliably performed as well as an addition and renewal and exchange of various line parts is made possible to be performed reliably by nonspecialists locally.

This object is obtained by a cage tension spring (38) disposed at a contact bolt of a bush part for connecting of conduit wires and wherein a connection bolt is furnished between a floor of a case and the cage tension spring for the contacting of a conduit braided screen.

Advantageous embodiments and further developments of the invention are defined by the features of the sub claims.

Further advantages and essential details of the invention can be gathered from the following description and the drawing, wherein the drawing shows preferred embodiments as examples in a schematic presentation. There is shown in:

DETAILED DESCRIPTION OF THE INVENTION

Figure 1:
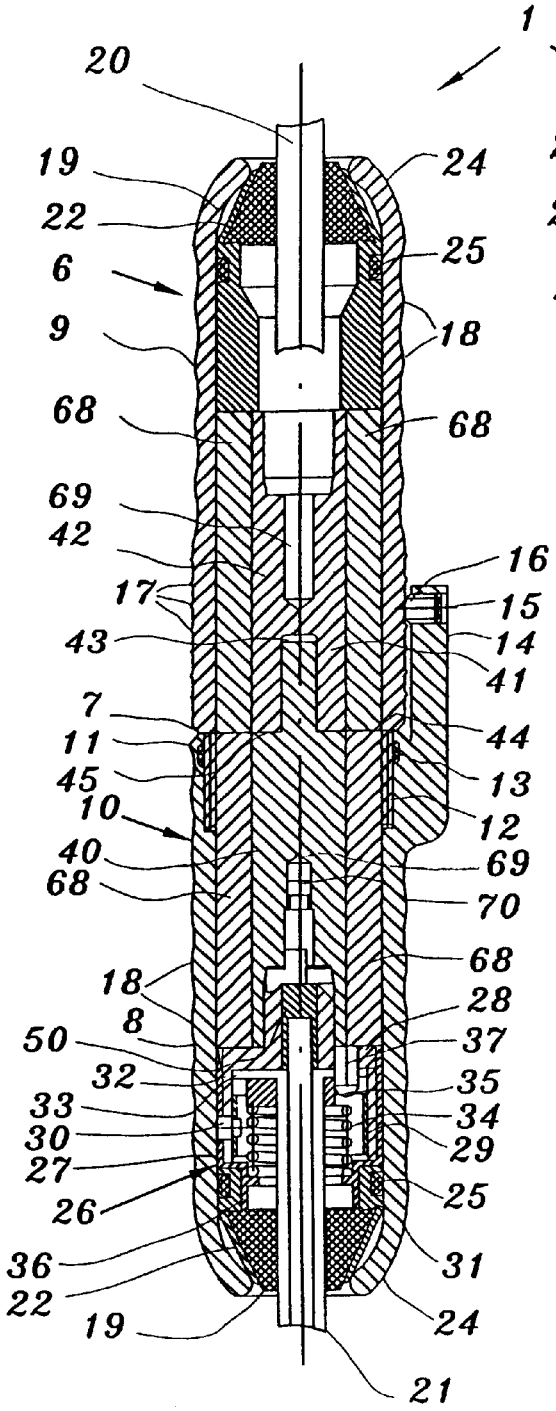
FIG. 1 a device according to the present invention formed as a heating line coupling in a view sectioned in longitudinal direction in the middle, FIG. 2 the device according to claim 1 in another sectional view, FIG. 3 a device according to the present invention formed as a heating line connection in a view sectioned in longitudinal direction in the center, FIG. 4 the device according to FIG. 3 in another sectional view, FIG. 5 a device according to the present invention formed as a heating line coupling in a view sectioned in longitudinal direction in the middle, FIG. 6 the device according to FIG. 5 in another sectional view, FIG. 7 a Y-shaped branch device, and FIG. 8 an X-shaped branch device.
Figure 2:
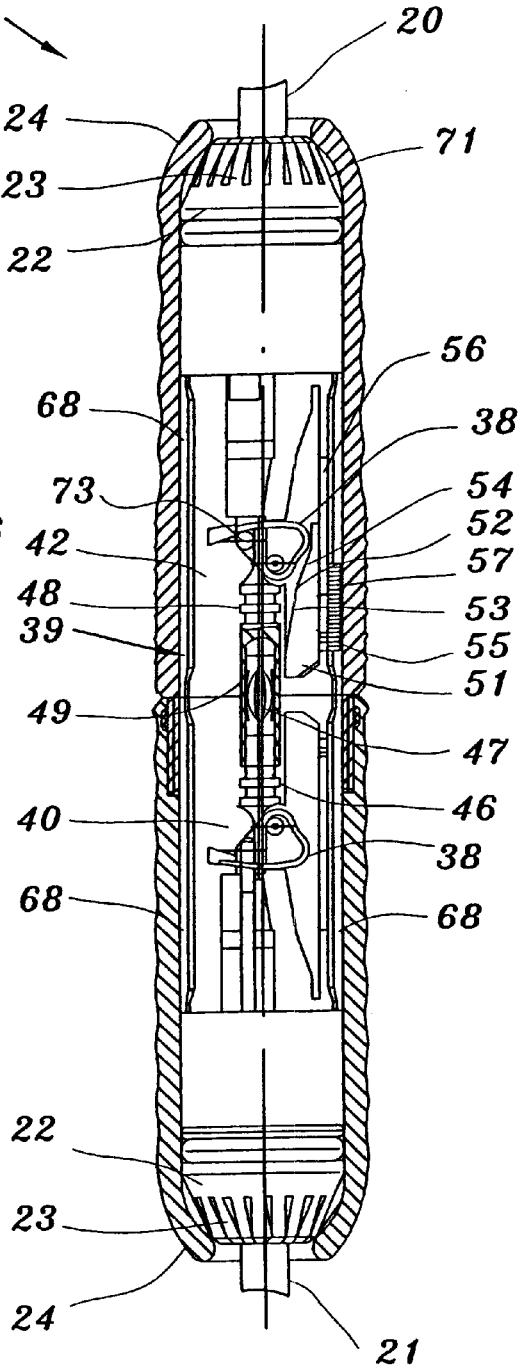
Figure 3:
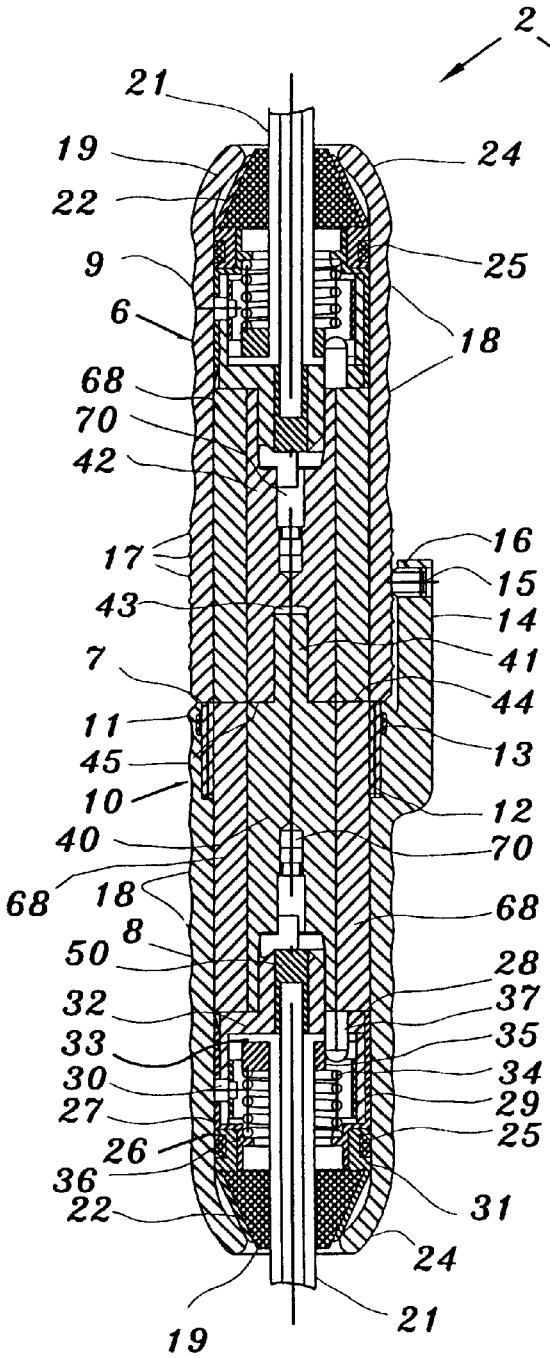

The device shown in the drawing is formed as a conductor arrangement and can be employed for standard electrical coupling lines 20 as well as for electrical heating conductors 21, heating cables and the like. The arrangement comprises according to FIGS. 1 and 2 a line terminal 1 with a connection line 20 and a heating conductor 21, according to the FIGS. 3 and 4 a line connection 2 with two heat conductors 21, according to FIGS. 5 and 6 a line terminator 3 with a heating conductor 21 and according to FIGS. 7 and 8 two branching off conductors.

The tubular shaped casing 6 of the line terminal 1 and of the line connector 2 are completely identical and thus for the two arrangements employable. Advantageously the casing 6 is made of a plastic resistant to heating temperatures, wherein the plastic can be furnished for continuous temperatures above 80 degrees centigrade. In addition the casing 6 is advantageously formed as a pressure proof encapsulation (protection d), such that in case of a possible explosion of a mixture capable to explode in the interior of the casing 6, the casing 6 reliably resists also at higher temperatures and a transfer of the explosion to the atmosphere surrounding the casing 6 is reliably prevented. In addition it can be advantageous to produce the line terminal 1, the connector 2 and the line termination 3 in the protection kind increased safety (protection e).

The casing 6 is furnished with a subdivision 7 and two casing parts 8, 9, wherein the casing parts 8, 9 can be construed together through a screw connection 10. This screw connection 10 comprises a threaded bush 11, which is formed at the one casing part 8 and a threaded connection 12, wherein the threaded connection 12 is formed at the other casing part 9 and is screwable into the threaded bush 11.

The casing part 8 exhibits a sealing part 13, wherein the sealing part 13 is supported in a groove of the threaded bush 11. The sealing part 13 can advantageously be made of an elastomeric material as a permanent elastic injection molding part, which engages shape matchingly into the steps of the thread of the threaded connection 12 upon screwing together of the two casing parts 8, 9. Advantageously liquid silicone can be employed for the production of the sealing part 13, wherein the liquid silicone is processed for example in 2 K-methods, wherein after the casing part 8 was bodily produced in the injection molding machine in a first shot, then in a second shot the liquid silicone is injected into the injection molding tool for the sealing part 13.

It can be recognized in addition from the drawing that a safety arm 14 is formed at a casing part 8, wherein the safety arm 14 grips over the other casing part 9. A threaded hole can be formed in the end region of the safety arm 14, wherein for example a so-called grub screw or headless screw formed as a securing screw 15 is adjustably supported in the threaded hole. The securing screw 15 can exhibit an anullar cutting-edge 16 at the end disposed toward the casing part 9, wherein the diameter of the anullar cutting-edge means amounts to from about 3 mm to 6 mm. For this purpose it is favorable if the outer side of the other casing part 9 exhibits about semi spherical shaped burl like projections 17 in the grip over region of the safety or securing arm 14. The anullar cutting-edge 16 grips over the corresponding projection 17 upon screwing up tightly of the securing screw 15 such that not only a force matching support is furnished but also a shape matching solid support. A bolting of the casing parts 8, 9, 58 independent of the position is possible both in axial as well as in radial direction by the securing arm 14. The casing parts 8, 9 are screwed together corresponding to the thickness of the conduits during assembly until the connection line 20 or, respectively, the heating conductor 21 are tensioned solidly and sealingly. As desired also relatively thick or thin conduits 20, 21 can be employed. This means that upon use of thicker or thinner conduits 20, 21 there exists a more or less large distance between the casing front sides.

The two casing parts 8, 9 are constructed such that the casing front sides or, respectively, the screw connection 10 are disposed about in the longitudinal center of the casing. The casing parts 8, 9 can exhibit preferably anullar shaped beads 18 at the casing part outer sides, wherein the anullar shaped beads 18 assure a high strength, in particular impact strength of the casing 6. The casing 6 can be constructed advantageously based on the specially formed anullar beads 18 such that it suffices the highest impact strength requirements according to the standard EN 50014. The anullar beads 18 effect that in case of mechanical loadings for example by falling down parts they are offered only minimal attack faces such that no punctual tip loading can occur, but instead an essentially uniform distribution of force occurs. The anullar beads 18 in addition effect a nonskid access, such that the casing part 8, 9 can be easily screwed together by hand.

Seals 19 are furnished between the conically narrowing end region of the casing parts 8, 9, wherein the seals 19 preferably consist of a heating temperature resistant elastomeric and narrowly surround the heating conductor 21. The seal 19 is supported here within a lamellar ring 22, wherein the lamellar ring 22 is furnished with the spring elastic fingers 23, wherein the spring elastic fingers 23 surround the seal 19 at the periphery of the seal 19. As the lamellar ring 22 with the fingers 23 formed as a single piece is advantageously produced also of a heating temperature resistant plastic material. The fingers 23 are pressed radially inwardly against the seal 19 through a conically narrowing collar 24 formed at the casing end region, such that the seal 19 becomes also conically deformed and surrounds sealingly the conduit 20, 21 for example in case of an explosion protected construction of the casing, under formation of an ignition puncture proof slot. A narrow web 71 can be formed at the inner side of the collar 24 of the casing part 8, 9, wherein the narrow web 71 engages into a slot between the fingers 23 of the lamellar ring 22, whereby a securing is furnished against unintentional disengagement during assembly. It can be advantageous to support a sealing ring 25 preferably formed as an O-ring in this anullar groove, wherein the sealing ring 25 rests under material elastic pretension at the inner side of the casing part 8, 9 for obtaining a problem free sealing between the lamellar ring 22 and the casing inner side and for minimizing the torsional forces acting on the conduits 20, 21 through the seal 19 during screwing together of the casing parts 8, 9.

The casing parts 8, 9 can exhibit a metal bush 26 joining at the seal 19, wherein heating conductor 21 is led into the metal bush 26. The metal bush 26 is furnished with a sleeve shaped case 28 formed of brass, wherein the sleeve shaped case 28 is inserted substantially free of play into the cap 27. In order to be able to join the cap 27 and the sleeve shaped case 28 to a disengageable construction unit, and nearly circular shaped bent flat spring 29 can be supported in the sleeve shaped case 28, wherein a radially outwardly directed securing pin 30 is attached at the flat spring 29, wherein the securing pin 30 engages into radial bores of the sleeve shaped case 28 and the cap 27. The cap 27 can exhibit a projection or connection 31 reduced in diameter, wherein the projection or connection 31 is directed toward the seal 19. The lamellar ring 22 can be plugged substantially free of play onto this projection or connection 31.

The case 28 has a floor 32, wherein a braiding screen 33 of the heating conductor 21 is contacting resting at the inner side of the floor 32, wherein a pressure plate 35 supported within the metal bush 26 and impinged with the end of a screw shaped compression spring 34 is pressed against the braided screen 33. The other end of the compression spring 34 is supported at a shoulder 36 of the cap 27. A cylinder part 70 is formed at the floor 32 of the case 28. In addition a connection bolt 37 can be furnished at the floor 32 of the case 28 for contacting the braided screen 33, wherein the connection bolt 37 is connected to a cage tension spring 38 through a connection of the connection bolt 37 and a cage tension spring end 74.

A subdividable plug-in coupling 39 is supported in the casing 6 of the line terminal 1 and of the line connector 2, wherein the subdividable plug-in coupling 39 exhibits a plug part 40 produced of a heating temperature stable plastic material with a pin 41 disposed asymmetrically relative to the longitudinal axis of the casing 6 and of bush part 42 also made of a heating temperature stable plastic material with a recess 43 corresponding to the pin 41, such that a restraint or, respectively protection against torsion is furnished and an erroneous assembly is avoided. Both the plug part 40 as well as the bush part 42 can exhibit a pocket hole 69, wherein the cylinder parts 70 of the sleeve shaped case 28 can be supported form matchingly, preferably thermally embedded in the pocket hole 69. The plug part 40 and the bush part 42 are constructed such that the front faces 44, 45 disposed toward each other are located approximately in the region of the subdivision 7 or, respectively, of the screw connection 10 of the casing 6. In addition, the plug part 40 and the bush part 42 can exhibit cover parts 68 wherein the cover parts 68 are formed preferably in cross section of circular segment shape such that the cover parts 68 together with the plug part 40 or, respectively, the bush part 42 form a circular shaped cylinder. The cover part 68 can be preferably disengageably connected to the plug part 40 and the bush part 42 and the cover parts 68 rest with their convex outer faces at the inner side of the casing parts 8, 9, 58.

Three contact pins 46 disposed off center and located star shaped are embedded in the plug part 40 in parallel to the longitudinal axis of the casing, wherein the contact pins exhibit a contact plug 47 pointing toward the bush part 42. The cage tension spring 38 is disposed at the other end of the three off center disposed and star like arranged contact bolts 48 are embedded in the bush part 42 also parallel to the longitudinal axis of the casing, wherein the contact bolts 48 have a contact bush 49 pointing toward the plug part 40. A cage tension spring 38 is equally disposed at the other end of the contact bolts 48. The connection bolts 37 and the individual electrical wires of the connection line 20 as well as of the heating conductor 21 are simply and reliably connected at the cage tension springs 38. Here the cage tension spring 38 is swivelable into an opening position against the spring force of the cage tension spring 38 such that the conductor wire can be plugged into an opening of the cage tension spring 38. Upon discharging of the cage tension spring 38, then the cage tension spring 38 swivels back based on its spring force in the direction of the starting position of the cage tension spring 38, whereby the conductor wire is solidly clamped and safely contacted.

It can be advantageous to dispose guide parts 50 with one or several channels for the conductor wires in the region of the plug part 40 and of the bush part 42 for passing the conductor wires during assembly substantially force led into the openings of the cage tension springs 38 such that the connecting of the conductor wires can also be reliably performed by auxiliary help personnel.

Both the plug part 40 as well as the bush part 42 can exhibit in addition a control opening 73 formed of the shape of a bore hole, wherein optically can be controlled through the control opening 73 if the conductor wire in fact is problem free contacted in the cage tension spring 38.

Advantageously a slider 51 made of a heating temperature stable plastic material can be furnished in order to be able to move the cage tension spring 38 for easily connecting of the conductor wire into the opening position, wherein the slider 51 exhibits an inclined face 52, wherein the inclined face 52 corresponds to the cage tension spring 38. The inclined face 52 can be furnished with a flat inclined face part 53 and with a stronger inclined face part 54 for an optimum slider function. In addition an actuator 55 can be coordinated to the slider 51, wherein the actuator 55 is advantageously slidably supported at the plug part 40 and/or at the bush part 42 for example in a guide groove 56. The actuator 55 can be furnished with a structured gripping face 57 for a secure handling of the actuator 55.

Figure 4:
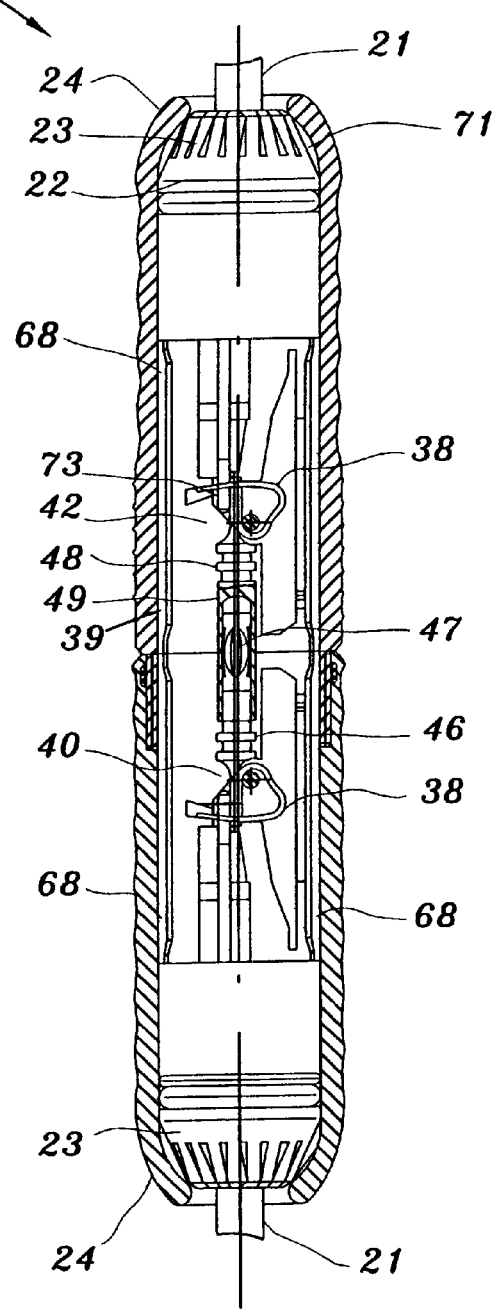
Figure 5:
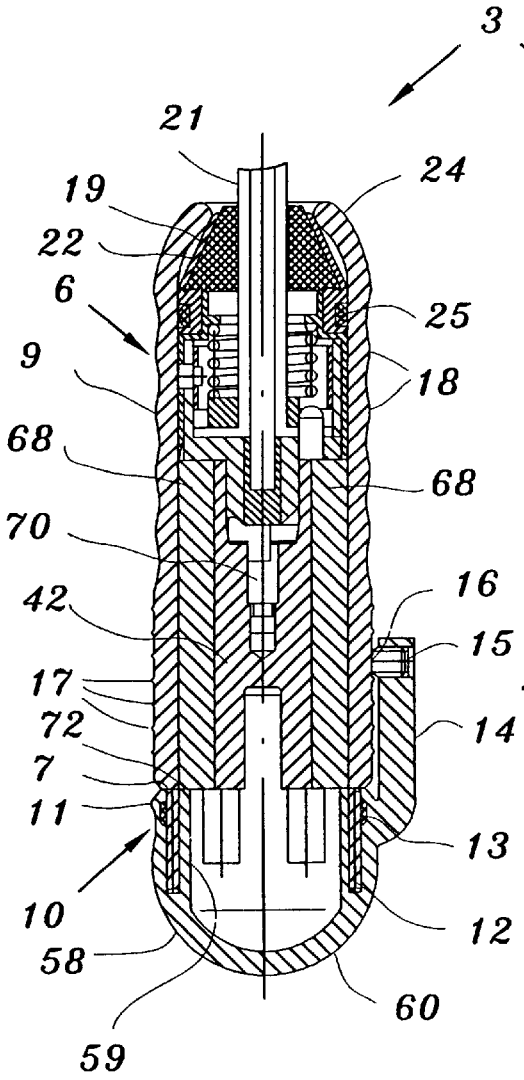
Figure 6:
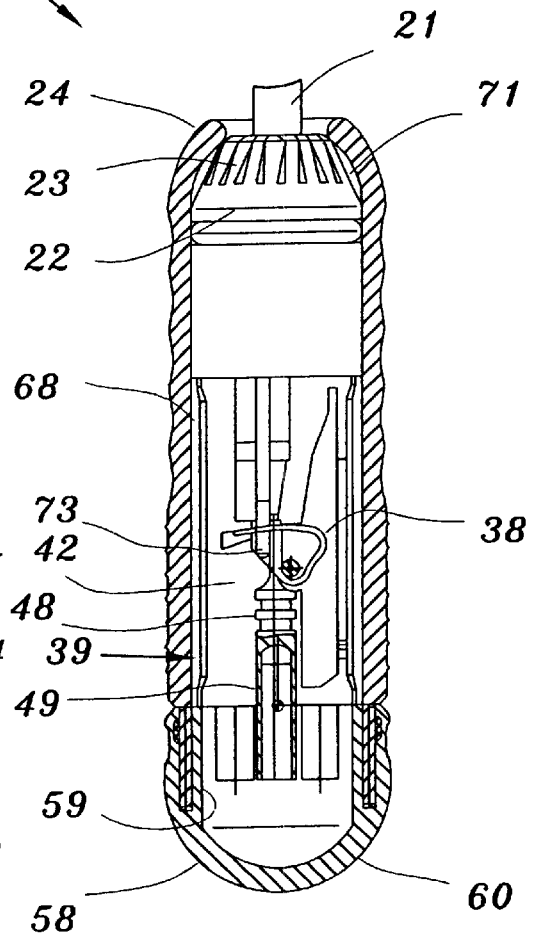

The line terminator 3 illustrated in FIGS. 5 and 6 comprises on the one hand the casing part 9 wherein as illustrated in FIG. 4 the bush part 42 is furnished with the cage tension spring 38, the lamellar ring, the seal ring 25, and the braided screen contact of the heating conductor 21 etc. In addition a cup shaped casing part 58 is furnished, wherein the cup shaped casing part 58 exhibits a threaded sleeve 11 with the integrated sealing part 13 receiving the threaded projection or connection 12. A sleeve shaped wall 59 stands parallel to be threaded sleeve 11, wherein the sleeve shaped wall 59 is constructed such that a relatively small distance exists between the threaded sleeve 11 and the sleeve shaped wall 59, wherein the threaded projection or connection 12 is supported during screwing together of the casing part 9, 58 in the relatively small distance. The front end 72 of the sleeve shaped wall 59 is disposed approximately in the region of the subdivision 7, respectively, of the front sides 44, 45 and rests at the cover parts 68 such that upon screwing together of the casing parts 8, 9 a counter support is formed and the seal 19 is pressed fixedly against the line 20, 21 through the shoulder 24. The casing part 58 is closed at the end disposed remote relative to the threaded sleeve 11 by way of a preferably about semi spherical shaped closing wall 60, such that no line in production is possible on this side.

Figure 7:
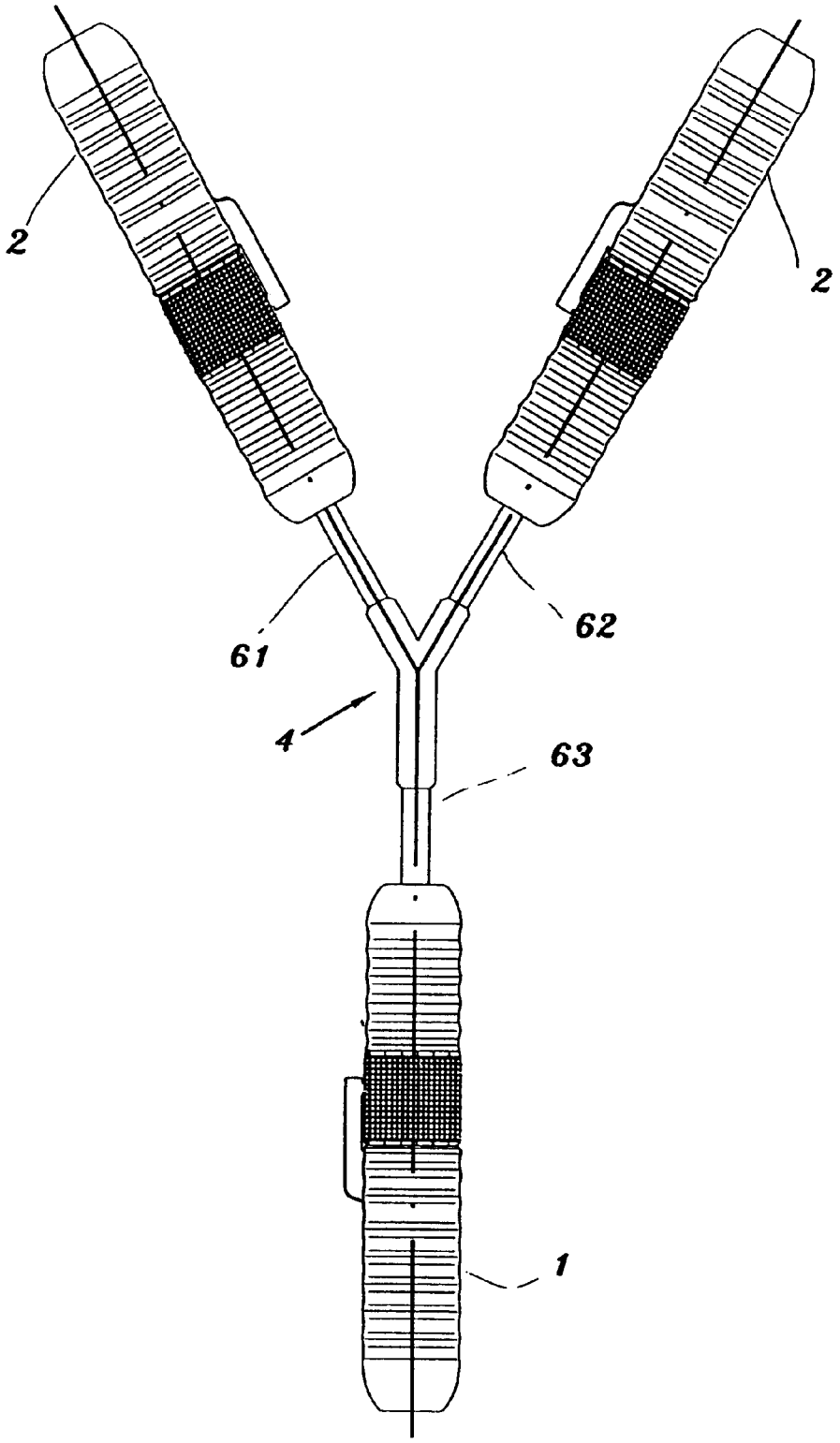

The Y-shaped line branch 4 illustrated in FIG. 7 exhibits three for example as heating conductor 21 furnished distributing lines 61, 62, 53, wherein in each case a line terminal 1 or a line connector or a line terminator 3 can be connected. The line branch 4 can exhibit an isolating envelope, wherein the isolating envelope is formed for example as a shrink on sleeve, wherein the shrink on sleeve envelopes the connection pieces connecting the individual conductor wires.

Figure 8:
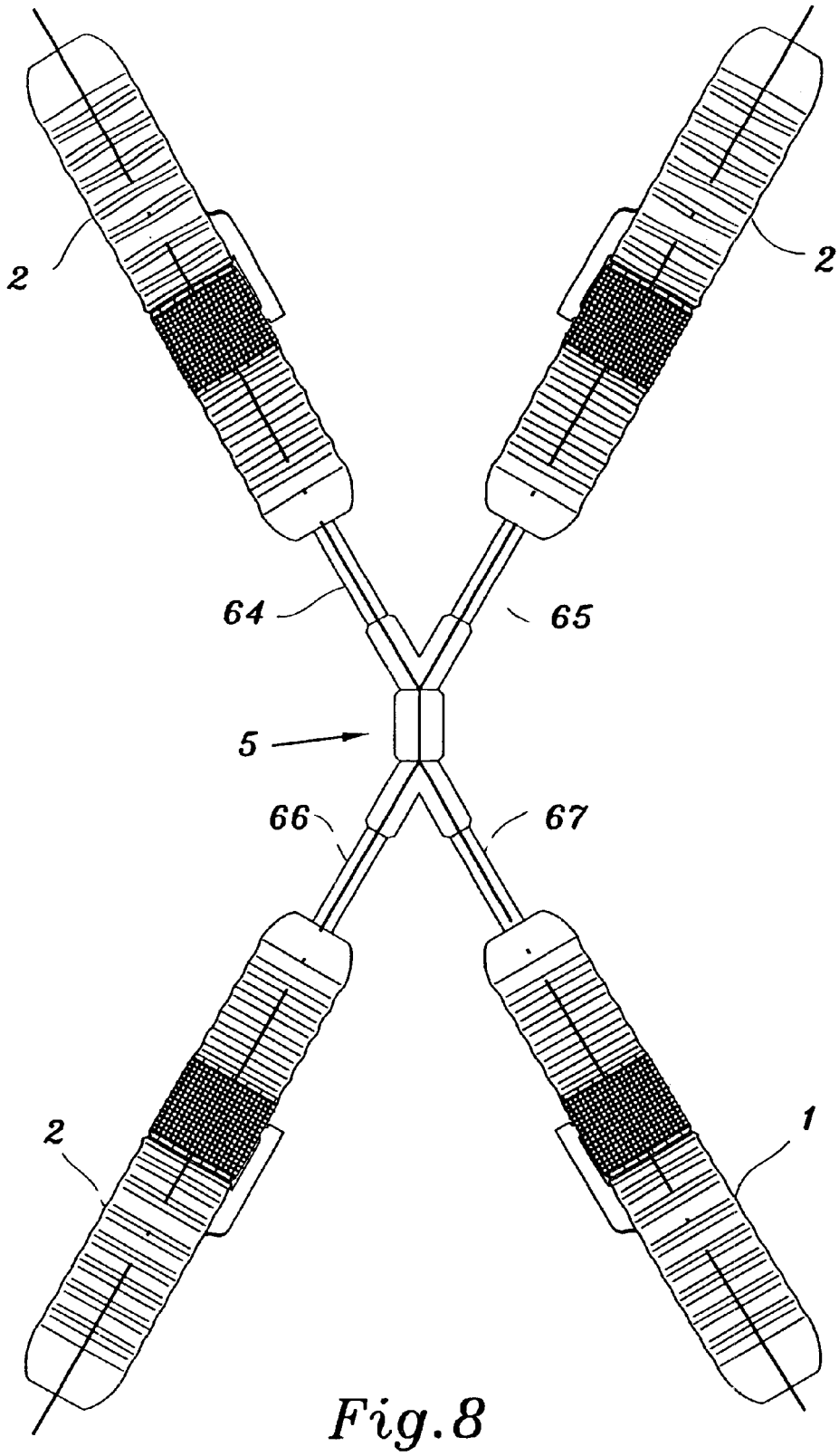
Figure 9:
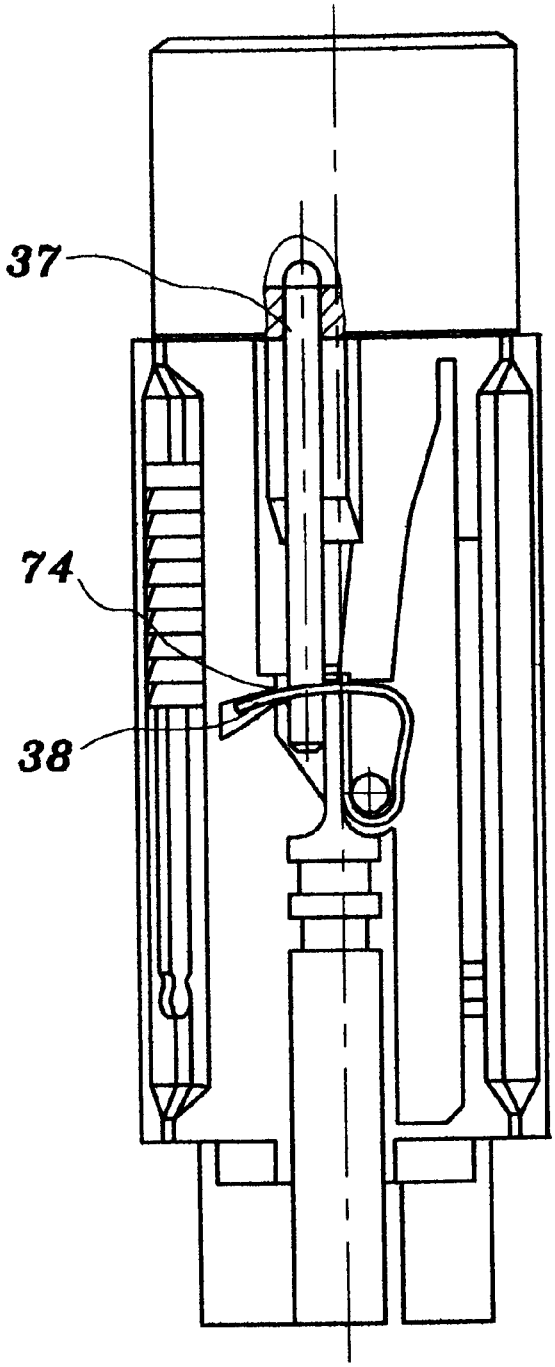
FIG. 9 shows the connection bolt (37) is connected to a cage tension spring (38).

The X-shaped line branch 5 according to FIG. 8 exhibits four distributing lines 64, 65, 66, 67, wherein either a line terminal 1, a line connector 2, or a line terminator 3 can be connected to the four distributing lines 64, 65, 66, 67. The distributing lines 64, 65, 66, 67 can for example be heating conductors 21. Again this X-shaped line branch 5 can advantageously be furnished with an isolating envelope, wherein the isolating envelope is preferably provided as a thermo shrinkable tubing, wherein the thermo shrinkable tubing envelopes the connection pieces of the individual conductor wires.

What is claimed is:

1. Device for an electrical conduit (20), a heating conductor (21), or heating cable, with a cross subdivided, tubular casing (6), which exhibits two casing parts (8, 15, 58) disengageably connected to each other, a bush part (42) having at least a contact bolt (48) disposed parallel to the longitudinal axis of the casing (6), characterized in that a cage tension spring (38) is connected to the contact bolt (48) of the bush part (42) for connecting to the conduit (20), wherein a connection bolt (37) is connected to the cage tension spring (38), and wherein the connection bolt (37) is furnished between a floor (32) of a case (28) and the cage tension spring (38) and wherein the connection bolt (37) contacts a conduit braided screen (33) of the heating conductor (21).

2. Device according to claim 1, characterized in that the contact bolt (48) has a contact bush (49) for receiving of a contact plug (47) disposed at a contact pin (46) of a plug part (40).

3. Device according to claim 1, characterized in that, the cage tension spring (38) is disposed at the contact bolt (48) of the bush part (42) and/or the contact pin (46) of a plug part (40).

4. Device according to claim 1, characterized in that, a plug part (40) and/or the bush part (42) exhibit a control opening (73) for the conductor wire contacting at the cage tension spring (38).

5. Device according to claim 1, characterized in that, a sealing part (13) is formed as a permanent elastic plastic material injection molding part preferably produced from liquid silicon.

6. Device according to claim 1, characterized in that, the casing part (8, 58) exhibits a safety arm (14), which grips over the other casing part (9).

7. Device according to claim 1, characterized in that, the safety arm (14) of the casing part (8,58) exhibits a securing screw (15), wherein the securing screw (15) is pressable against the other casing part (9).

8. Device according to claim 1, characterized in that, the cage tension spring (38) is movable with a slider (51) into an opening position.

9. Device according to claim 8, characterized in that, the slider (51) exhibits an inclined face (52) corresponding to the cage tension spring (38).

10. Device according to claim 9, characterized in that, the inclined face (52) of the slider (51) exhibits a flat inclined face part (53) and a stronger inclined face part (54).

11. Device according to claim 10, characterized in that, the slider (51) is movable with an actuator (55) furnished advantageously at the bush part (42) and/or plug part (40), wherein the actuator (55) exhibits advantageously a structured gripping face (57).

12. Device according to claim 10, characterized in that, a plug-in coupling (39) exhibits a forced guide for preventing an erroneous assembly of the bush part (42) and of the plug part (40).

13. Device according to claim 12, characterized in that, the forced guide of the plug-in coupling (39) comprises a pin (41) asymmetric relative to the longitudinal axis, wherein the pin (41) engages shape matching into a correspondingly formed recess (43).

14. Device according to claim 13, characterized in that, the pin (41) of the forced guide is formed at the plug part (40) and the recess is formed at the bush part (42).

15. Device according to claim 14, characterized in that, the plug part (40) and the bush part (42) are surrounded by cover parts (68) having a circular segment shaped cross-section.

16. Device according to claim 15, characterized in that, the plug part (40) and the bush part (42) exhibit a pocket hole (69) receiving a cylinder part (70) of a sleeve shaped case (28).

17. Device according to claim 16, characterized in that, the casing parts (8,15,58) exhibit a screw connection (10).

18. Device according to claim 17, characterized in that, the casing part (8,58) exhibits a threaded sleeve (11) for receiving of a threaded connection (12) furnished at the casing part (9).

19. Device according to claim 18, characterized in that, a sealing part (13) is furnished between the threaded (11) and the threaded connection (12).

20. Device according to claim 19, characterized in that, the sealing part (13) is embedded in a groove of the threaded (11) and engages the threaded connection (12).

21. An electrical connector device comprising a first tubular casing part (9) having a first axis and having a free end and a connection end;

a conduit wire passing through the free end of the first tubular casing part;

a second tubular casing part (8, 58) having a second axis and having a free end and a connection end and disengageably connected with its connection end to the connection end of the first tubular casing part (9) and wherein the first axis coincides with the second axis when the first tubular casing part (9) is connected to the second tubular casing part (8, 58);

a heating conductor passing through the free end of the second tubular casing part;

a bush part (42) disposed in the first tubular casing part (9);

a contact bolt (48) is embedded in the bush part (42) and disposed in the first tubular casing part (9) and disposed parallel to the longitudinal axis of the first tubular casing part (9) and connected to the conduit wire;

a cage tension spring (38) disposed at the contact bolt (48) of the bush part (42) and connected to the contact bolt;

a case (28) disposed in the second tubular casing part (8, 58);

a floor (32) of the case (28);

a conduit braided screen (33) connected to the heating conductor;

a connection bolt (37) is connected to the cage tension spring (38) and furnished between the floor (32) of the case (28) and the cage tension spring (38) for the contacting of the conduit braided screen (33).

22. An electrical connector device comprising a first tubular casing part (9) having a first axis and having a free end and a connection end;

a conduit wire passing through the free end of the first tubular casing part;

a second tubular casing part (8, 58) having a second axis and having a free end and a connection end and disengageably connected with its connection end to the connection end of the first tubular casing part (9) and wherein the first axis coincides with the second axis when the first tubular casing part (9) is connected to the second tubular casing part (8, 58);

a heating conductor passing through the free end of the second tubular casing part;

a contact bolt (48) is embedded in a bush part (42) and disposed in the first tubular casing part (9) and disposed parallel to the longitudinal axis of the first tubular casing part (9) and connected to the conduit wire;

a cage tension spring (38) disposed at the contact bolt (48) of the bush part (42) and connected to the contact bolt;

a connection bolt (37) connected to the cage tension spring (38);

a conduit braided screen (33) connected to the heating conductor and to the connection bolt (37).

* * * * *